US005986387A

United States Patent [19]

Niigaki et al.

[11] Patent Number: 5,986,387

[45] Date of Patent: Nov. 16, 1999

[54] TRANSMISSION TYPE ELECTRON MULTIPLIER AND ELECTRON TUBE PROVIDED

[75] Inventors: Minoru Niigaki; Toru Hirohata; Hirofumi Kan; Masami Yamada, all of Hamamatsu, Japan

[73] Assignee: Hamamatsu Photonics K.K., Hamamatsu, Japan

[21] Appl. No.: 08/964,890

[22] Filed: Nov. 5, 1997

[30] Foreign Application Priority Data

Nov. 7, 1996 [JP] Japan ..... 8-295189

[51] Int. Cl.[6] ..... H01J 31/50

[52] U.S. Cl. ..... 313/103 R; 313/528; 313/530

[58] Field of Search ..... 313/528, 530, 313/532, 534, 539, 541, 103 R, 103 CM, 105 CM, 104

[56] References Cited

U.S. PATENT DOCUMENTS

| | | | |
|---|---|---|---|
| 3,437,752 | 4/1969 | Ford | 178/7.87 |
| 3,478,213 | 11/1969 | Simon et al. | 250/207 |
| 3,986,065 | 10/1976 | Pankove | 313/94 |
| 4,071,474 | 1/1978 | Kishimoto | 252/500 |
| 4,481,531 | 11/1984 | Warde et al. | 358/60 |
| 5,023,511 | 6/1991 | Phillips | 313/524 |
| 5,180,951 | 1/1993 | Dworsky et al. | 315/169.3 |
| 5,402,034 | 3/1995 | Blouch et al. | 313/370 |
| 5,493,174 | 2/1996 | Mori | 313/371 |
| 5,504,324 | 4/1996 | Armentrout | 250/241 VT |
| 5,563,653 | 10/1996 | Floryan | 348/217 |
| 5,569,355 | 10/1996 | Then et al. | 156/643.1 |
| 5,680,008 | 10/1997 | Brandes et al. | 313/533 |

FOREIGN PATENT DOCUMENTS 1 475 597 6/1977 United Kingdom .

97/44805 11/1997 WIPO .

OTHER PUBLICATIONS

Physical Review B, vol. 2, No. 2 pp. 624–627 "Quantum Photoyield of Diamond (111)–A Stable Negative–Affinity Emitter" F.J. Himpsel et al. Feb. 14, 1979.

Mearini, et al., "Fabrication of an electron multiplier utilizing diamond films", Thin Solid Films, Dec. 15, 1994, No. 1.2, pp. 151–156.

Thin Solid Films 235 (1994) 151–156 "Fabrication of an Electron Multiplier Utilizing Diamond Films" G.T. Mearini et al.

Surface and Interface Analysis, vol. 21, 138–143 (1994) "Investigation of Diamond Films for Electronic Devices" G. T. Mearini et al.

Physical Review B, vol. 53, No. 12, Mar. 15, 1996–II "Negative–Electron–Affinity Effect on the Surface of Chemical–Vapor–Deposited Diamond Polycrystalline Films" I.L. Krainsky et al P. 02/13–05/13.

*Primary Examiner*—Vip Patel
*Assistant Examiner*—Matthew Gerile
*Attorney, Agent, or Firm*—Pillsbury Madison & Sutro LLP

[57] ABSTRACT

This invention relates to a transmission type electron multiplier having a high secondary electron generation efficiency and having the structure capable of detecting positions of incidence of detected light, and also to an electron tube provided therewith. The electron tube comprises a closed container, an electron source, housed in the closed container, for emitting electrons into the closed container, an anode disposed so as to face the electron source, and a transmission type electron multiplier disposed between the electron source and the anode. Particularly, the transmission type electron multiplier comprises a thin film of diamond or a material containing a principal component of diamond, and a reinforcing member for reinforcing the thin film, the reinforcing member having an aperture for exposing a part of the thin film.

11 Claims, 5 Drawing Sheets

TRANSMISSION TYPE ELECTRON MULTIPLIER AND ELECTRON TUBE PROVIDED

BACKGROUND OF THE INVENTION

1. Field of the Invention

The present invention relates to a transmission type electron multiplier for undergoing secondary electron multiplication of incident electron and an electron tube provided therewith.

2. Related Background Art

In recent years, means using diamond is drawing attention as electron multiplying means used in the electron tube. The reason why attention is focused on diamond is that diamond has a negative electron affinity and thus has a high efficiency of generation of secondary electron. Thin Solid Films, 253 (1994) 151, reports a reflection type electron multiplier as an example of the electron multiplying means using diamond. This electron multiplier is composed of a substrate of Mo, Pd, Ti, or AlN, or the like and a diamond thin film the surface of which is hydrogen-terminated, disposed on the substrate, thereby enhancing the emission efficiency of secondary electron.

SUMMARY OF THE INVENTION

The inventors investigated the above-discussed conventional technology and found the following problem. In the diamond thin film of the reflection type electron multiplier discussed above, the surface for incidence of primary electron is also the surface for emission of secondary electron. This raises such a problem that when primary electrons are incident in a two-dimensional distribution to the diamond thin film and when secondary electrons are emitted similarly in a two-dimensional distribution from the surface to which the primary electrons were incident, it is essentially impossible to extract the secondary electrons as a signal with keeping information of the two-dimensional distribution, because of the geometrical arrangement of electron source, electron multiplier, and anode. Therefore, positions of incidence of light to be detected (hereinafter referred to as detected light) cannot be detected with the electron tube incorporating such a reflection type electron multiplier.

An object of this invention is, therefore, to provide a transmission type electron multiplier having a high secondary electron generation efficiency and having the structure capable of detecting the positions of incidence of detected light and an electron tube incorporating the transmission type electron multiplier.

A transmission type electron multiplier according to the present invention is electron multiplying means for secondarily multiplying an electron incident thereto to output secondary electrons, and an electron tube to which the transmission type electron multiplier can be applied comprises at least a closed container, an electron source housed in the closed container and emitting electrons into the closed container, an anode housed in the closed container and located to face the electron source, and the transmission type electron multiplier provided between the electron source and the anode.

In particular, a transmission type electron multiplier according to the present invention comprises: a diamond thin film servicing as electron multiplying means of diamond or a material mainly composed of diamond, the diamond thin film having a first major surface to which electrons from an electron source are incident and a second major surface, facing the first major surface, for outputting secondary electrons; and a reinforcing member for supporting the diamond thin film to make up for rigidity of the diamond thin film, the reinforcing member having an aperture for exposing at least a part of the diamond thin film.

When the electron multiplying means is comprised of the thin film of a predetermined thickness of diamond with a high secondary electron emission efficiency as described above, it becomes possible for electrons generated by secondary electron multiplication to efficiently pass through the thin film. The diamond thin film is preferably of an aggregate of polycrystalline or porous particles independent of each other, in terms of mass production and production cost.

The reinforcing member in the transmission type electron multiplier according to the present invention can be constructed not only in the structure wherein the reinforcing member is mounted on one major surface of the diamond thin film to reinforce the diamond thin film, but also in the following structure. Specifically, the reinforcing member may be of such structure that the diamond thin film is reinforced by making a pair of members (first and second members) hold edge parts of the diamond thin film. In this case, each of the first and second members is provided with an aperture for exposing the first or second major surface of the diamond thin film, thereby allowing incidence and emission of electron.

Further, the reinforcing member may be constructed in such structure as to hold the diamond thin film by a pair of plate members (third and fourth members) having a plurality of apertures. Particularly, in the case of this structure, the rigidity of the diamond thin film can be made up for sufficiently, because each member can be attached to the diamond thin film so as to cover the whole of the first or second major surface of diamond thin film. Since each member has the plurality of apertures, the most of each major surface is exposed in the diamond thin film. Therefore, the transmission type electron multiplier can be obtained with strength enough to endure handling upon fabrication or the like.

On the other hand, in the electron tube incorporating the transmission type electron multiplier according to the present invention, the transmission type electron multiplier can efficiently undergo the secondary electron multiplication of electrons emitted from predetermined positions of the electron source to make secondary electrons incident to the anode.

In the above electron tube, if the electron source is a photocathode for emitting photoelectrons in correspondence to positions of incidence of light to be detected and if the anode has a fluorescent film for, with incidence of secondary electrons emitted in correspondence to positions of incidence to the transmission type electron multiplier where the photoelectrons from the photocathode are incident, emitting light in correspondence to positions of incidence of the secondary electrons, the light to be detected can be imaged. Namely, the electron tube incorporating the transmission type electron multiplier can also obtain two-dimensional information of incident positions of detected light or the like.

The photocathode herein is an electrode for emitting photoelectrons excited from the valence band to the conduction band by incident light.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

Figure 1:
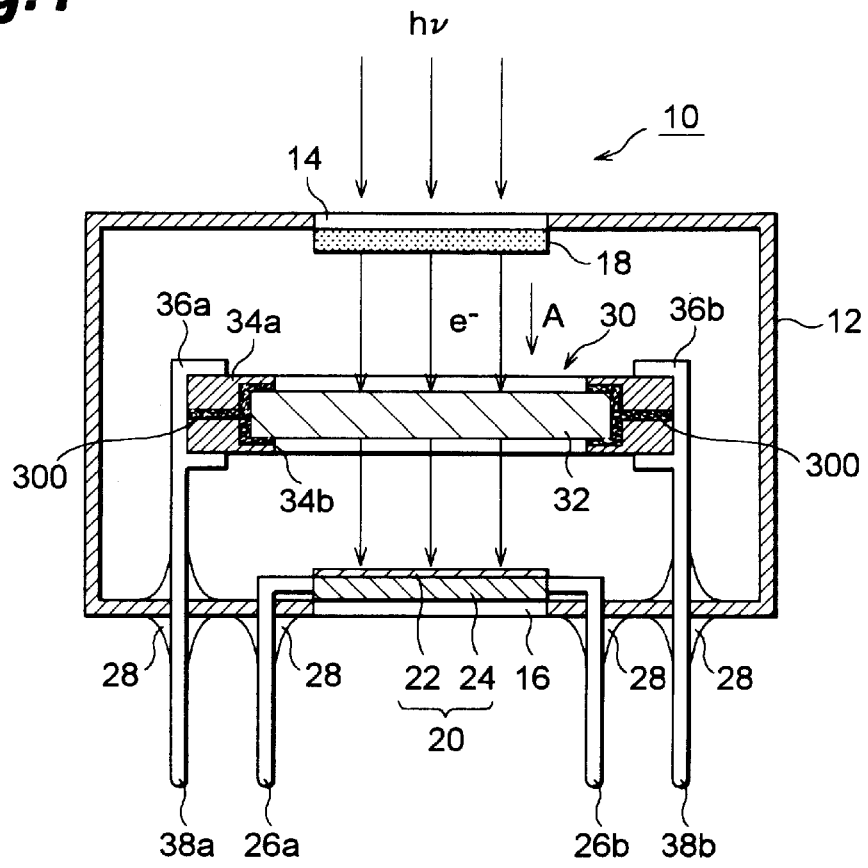
FIG. 1 is a cross-sectional view schematically showing the structure of an electron tube to which the first embodiment of the electron multiplier according to the present invention is applied.

The preferred embodiments of the present invention will be described in detail with reference to FIG. 1 to FIG. 10. In the drawings, equivalent or correspondent portions will be denoted by same reference symbols.

FIG. 1 shows the structure of the electron tube to which the first embodiment of the electron multiplier according to the present invention is applied, and the electron tube is an image intensifying tube 10 capable of detecting weak light incident thereto as intensified two-dimensional image information. A closed container 12, the inside of which is under reduced pressure, has an entrance window 14 for permitting the detected light to enter the inside and a detection window 16 for permitting the detected light intensified to be emitted to the outside in such an arrangement that the entrance window 14 and detection window 16 are opposed to each other. The photocathode 18 as an electron source is disposed on the internal surface of entrance window 14 and the anode 20 including a glass sheet 24 coated with a fluorescent material (fluorescent film) 22 is disposed on the internal surface of detection window 16. One end of stem pin 26*a*, 26*b* is electrically connected to each side face of the anode 20 and the other end of each stem pin 26*a*, 26*b* extends through the closed container 12 to the outside. The stem pins 26*a*, 26*b* are fixed to the closed container 12 by hermetic glass 28, whereby the anode 20 is fixed. A predetermined positive voltage to the photocathode 18 is applied through the stem pins 26*a*, 26*b* to the anode 20.

Figure 2:
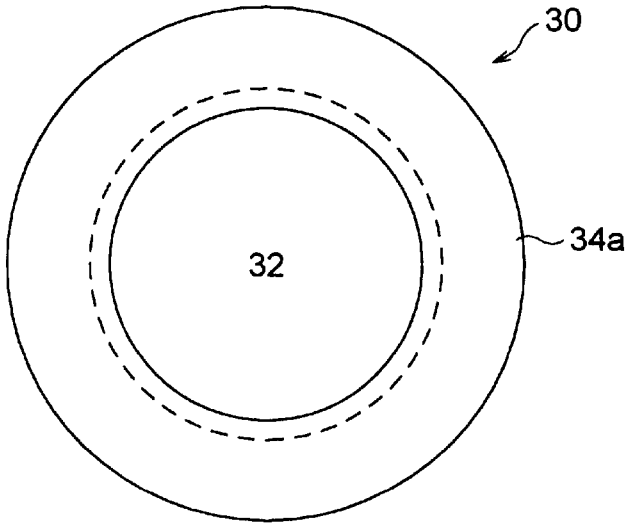
FIG. 2 is a plan view of the electron multiplier obtained when the electron multiplier of the first embodiment is viewed along the direction indicated by arrow A in FIG. 1.

The transmission type electron multiplier 30 is placed between the photocathode 18 and the anode 20. The transmission type electron multiplier 30 of this embodiment has a polycrystalline diamond thin film 32 of a circular shape having a negative electron affinity, as shown in FIG. 1 and FIG. 2, in terms of mass production and production cost. At this time, the diamond thin film 32 desirably has a thickness smaller than the mean free path of secondary electron, but the mean free path strongly depends upon crystallinity of the diamond thin film 32.

On the other hand, the diamond thin film 32 itself needs to have a thickness to present sufficient mechanical strength. The mechanical strength depends upon the crystallinity of the diamond thin film 32, a percentage of non-diamond components in the diamond thin film 32, and the density or the area of the diamond thin film 32. Therefore, the thickness of the diamond thin film 32 should be determined depending upon the quality of film achieved in consideration of various conditions for film formation of the diamond thin film 32.

Further, since in this embodiment the diamond layer is of a thin film, the rigidity thereof is low. It is thus readily deformed or damaged. Hence, a pair of annular metal reinforcing frames 34*a*, 34*b*, for example, of molybdenum (Mo) are attached to the periphery of the diamond thin film 32 so as to nip the thin film, thereby making up for the low rigidity of the diamond thin film 32.

In this embodiment of FIG. 1 and FIG. 2, stem pins 38*a*, 38*b* are fixed to the closed container by hermetic glass 28 so as to extend through the closed container 12. Each stem pin 38*a*, 38*b* has a nipping portion 36*a*, 36*b* at the top end thereof to nip the peripheral edge of reinforcing frame 34. By this arrangement, the transmission type electron multiplier 30 is fixed between the photocathode 18 and the anode 20. Preferably, a positive voltage of several 100 V to several 1000 V to the photocathode 18 is applied to the transmission type electron multiplier through the stem pins 38*a*, 38*b*, while a negative voltage of several 100 V to several 1000 V is applied to the anode.

Figure 3:
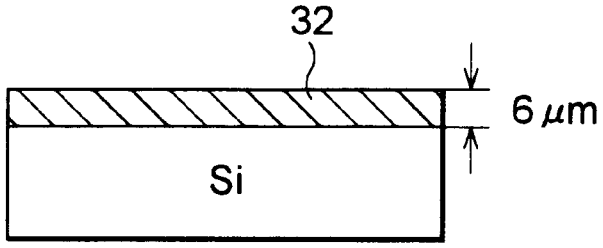
FIGS. 3–5 are views schematically showing processes for making the electron multiplier according to the present invention, respectively.
Figure 4:
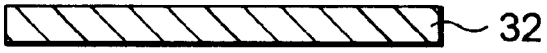
Figure 5:
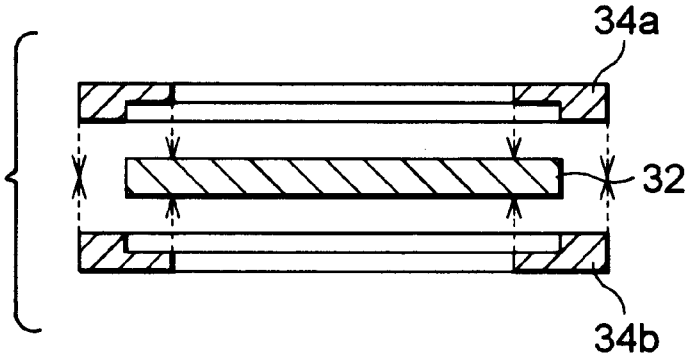

FIGS. 3–5 are views schematically showing processes for making the transmission type electron multiplier 30. In this fabricating process, the microwave plasma enhanced chemical vapor deposition (hereinafter referred to as "microwave plasma CVD") method is used for fabricating the transmission type electron multiplier 30.

First, a commercially available Si substrate is placed in a deposition chamber of a microwave plasma CVD system. The reason why this Si substrate is used is that since the Si substrate has the stable quality, it is advantageous in fabricating the diamond thin film. Next, as shown in FIG. 3, a plasma state is achieved by microwave when hydrogen as excitation gas is introduced into the deposition chamber. When in this state methane ($CH_4$) as a raw material for the diamond thin film is introduced into the deposition chamber, $CH_4$ is dissociated by hydrogen ions near an inlet port of the deposition chamber. Since carbon obtained by dissociation of $CH_4$ is deposited in the diamond type crystal structure on the Si substrate, the diamond thin film is formed, for example, in the thickness of about 6 $\mu$m at this time.

Since this fabrication process employs Si for the substrate, a large-area, uniform diamond thin film can be made. The diamond thin film may be one doped with boron (B), having the conduction type of the p-type, by also introducing diborane ($B_2H_6$) upon the film formation of diamond thin film. Doping with B is not always essential, but, according to the experiment results by the inventors, the B-doped diamond thin film has a higher secondary electron generation efficiency than the diamond thin film without doping of B, especially, when used at a high accelerating voltage. After the film formation, as shown in FIG. 4, the Si substrate is removed by etching with a mixed solution of hydrofluoric acid plus nitric acid ($HF+HNO_3$), thereby obtaining the polycrystalline diamond thin film. The periphery of this diamond thin film is bonded to the reinforcing frames 34*a* and 34*b* of Mo through adhesive 300, whereby the diamond thin film is mechanically nipped (see FIG. 5).

When the detected light (Hv) is incident into the entrance window 14 in the image intensifying tube 10 of FIG. 1, photoelectrons ($e^-$), which are primary electrons, are emitted from the bottom surface of the photocathode 18 in the form of a two-dimensional photoelectron image corresponding to positions of incidence of the detected light. Since the predetermined voltage to the photocathode 18 is applied through the stem pins 36*a*, 36*b* to the transmission type electron multiplier 30, the photoelectrons forming the two-dimensional photoelectron image are accelerated to enter the transmission type electron multiplier.

Figure 6:
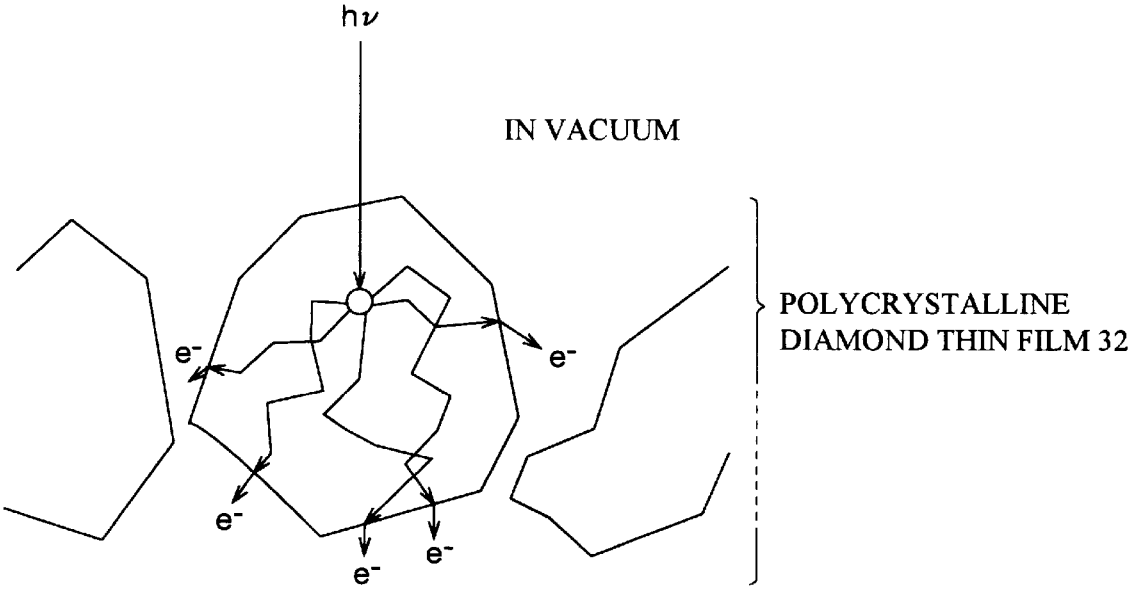
FIG. 6 is a drawing for explaining the behavior of photoelectrons generated in a polycrystalline diamond thin film, in the thin film.

The photoelectrons forming the two-dimensional photoelectron image, thus incident to the electron multiplier, lose energy in the polycrystalline diamond thin film 32 of the uniform thickness to create electron-hole pairs as shown in FIG. 6, thereby multiplicatively generating secondary electrons. At this time, the secondary electron generation efficiency is high, because the diamond thin film 32 has the negative electron affinity. Such secondary electrons efficiently move mainly along grain boundaries to the bottom surface, because the diamond thin film 32 is polycrystalline. The secondary electrons are uniformly emitted in correspondence to a position of incidence of photoelectron with a spread of several $\mu$m, which would pose no problem in practical use, from the bottom surface of the diamond thin film as indicated by arrows in FIG. 6. Accordingly, the secondary electrons (forming a secondary electron image) resulted from the multiplicative generation corresponding to the two-dimensional photoelectron image formed by the incident photoelectrons are emitted from the bottom surface of the transmission type electron multiplier.

Since the positive voltage to the transmission type electron multiplier 30 is applied to the anode 20, the secondary electrons forming the secondary electron image are incident to the anode 20. The kinetic energy that the secondary electrons lose upon incidence thereof causes the fluorescent material 22 to emit fluorescence at predetermined positions (corresponding to the positions of incidence of the secondary electrons), and a two-dimensional image corresponding to the secondary electron image can be observed through the detection window 16. Therefore, the electron tube incorporating the transmission type electron multiplier 30 of this embodiment can obtain the two-dimensional image corresponding to the positions of incidence of weak detected light in an efficiently intensified state.

The polycrystalline diamond thin film 32 included in the transmission type electron multiplier 30 of the first embodiment may be formed in a porous state, thereby emitting the secondary electrons more efficiently. For fabricating such a porous diamond thin film, the microwave plasma CVD process is also used as in the fabrication process of the polycrystalline diamond thin film 32 described above. In this method, the density of diamond thin film can be controlled to some extent by film-forming conditions, for example, by the pressure of hydrogen gas upon film formation. By increasing the pressure to a relatively high level, the so-called porous polycrystalline diamond thin film of relatively low density can be obtained.

The diamond thin film 32 obtained at this time can be deemed substantially as an aggregate of particles independent of each other. The mechanical strength of this diamond thin film 32 itself is thus lowered, and the diamond thin film needs to have a larger thickness than the aforementioned film.

The method for making the porous polycrystalline diamond thin film 32 is not limited to the above method, but such diamond thin film 32 may also be fabricated, for example, by a method for sintering fine particles of granular monocrystalline diamond.

The pair of reinforcing frames 34 are not limited to the embodiment of FIG. 1 and FIG. 2 for nipping the peripheral edge of the diamond thin film.

Figure 7:
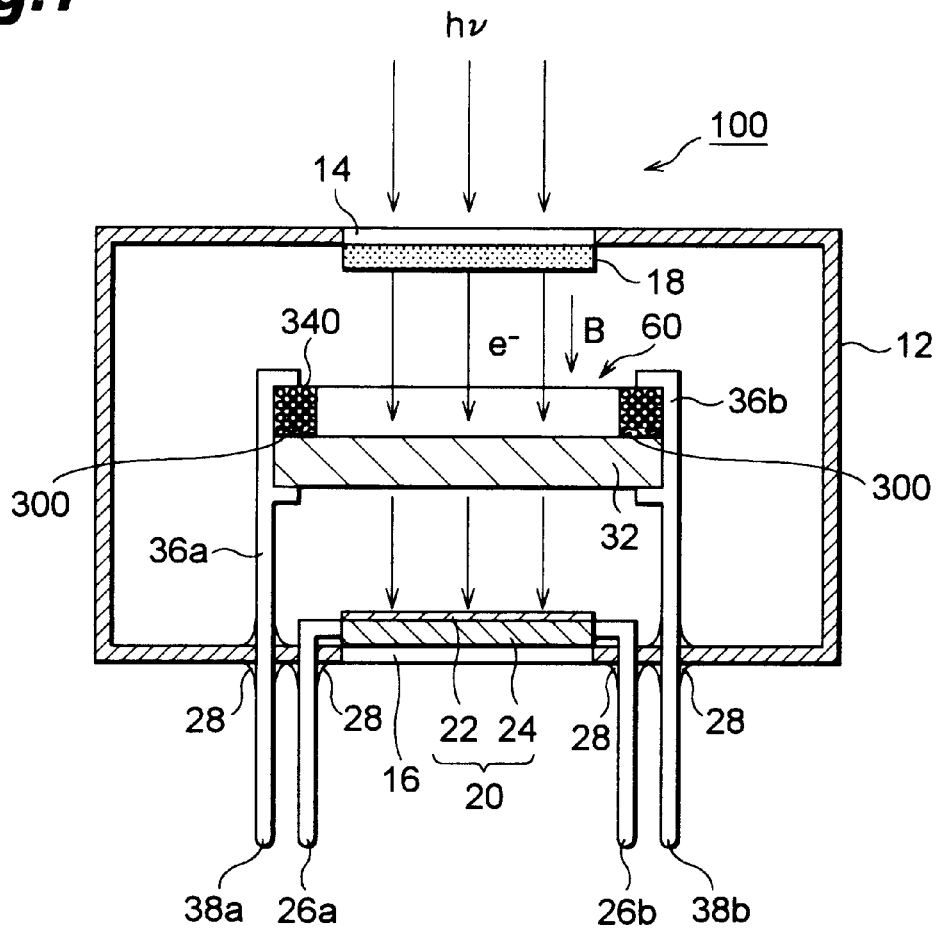
FIG. 7 is a cross-sectional view schematically showing the structure of an electron tube to which the second embodiment of the electron multiplier according to the present invention is applied.
Figure 8:
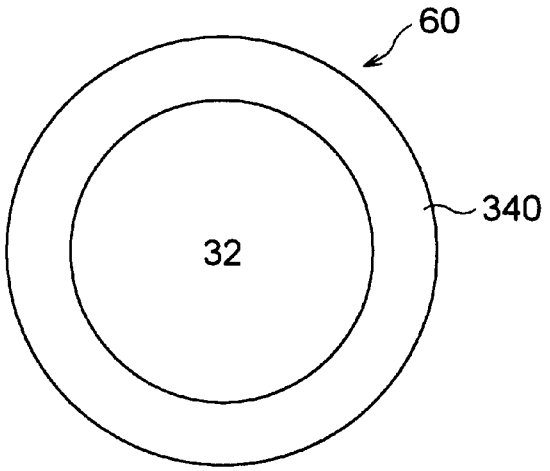
FIG. 8 is a plan view of the electron multiplier obtained when the electron multiplier of the second embodiment is viewed along the direction indicated by arrow B in FIG. 6.

Specifically, FIG. 7 and FIG. 8 show the structure of the second embodiment of the transmission type electron multiplier according to the present invention. In this embodiment an annular reinforcing frame 340 of Si is attached to the upper peripheral portion of the above polycrystalline diamond thin film 32, thereby making up for the rigidity.

For obtaining the polycrystalline diamond thin film 32 to which the reinforcing frame 340 is attached through adhesive 300, a fine polycrystalline diamond thin film is first formed on the Si substrate by the microwave plasma CVD process and thereafter the peripheral edge of the Si substrate is masked by a photoresist or the like. Next, the central portion of the Si substrate is removed by etching with the mixed solution of HF and $HNO_3$, thereby obtaining the polycrystalline diamond thin film 32.

It is a matter of course that the diamond thin film 32, which is supported and reinforced by the reinforcing frame 340 in the transmission type electron multiplier 60 of the second embodiment, may be the porous one.

Figure 9:
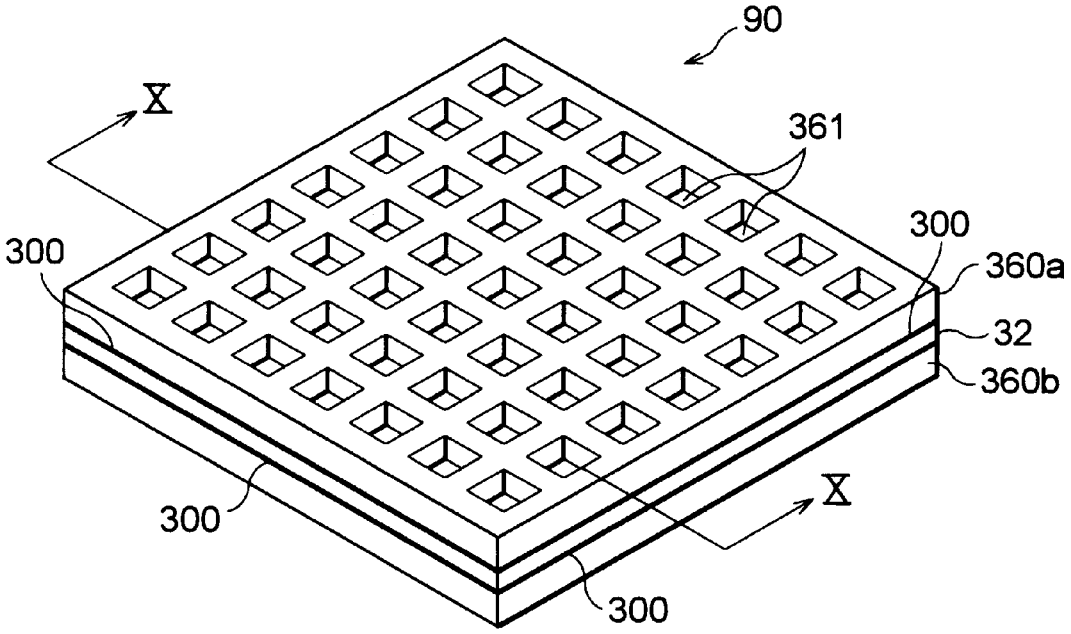
FIG. 9 is a perspective view schematically showing the structure of the third embodiment of the electron multiplier according to the present invention.
Figure 10:
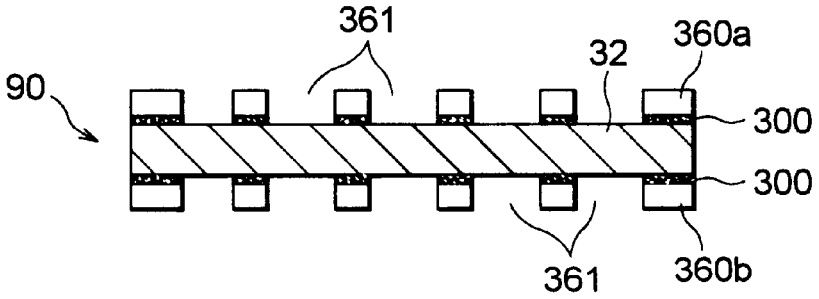
FIG. 10 is a cross-sectional view schematically showing the structure of the third embodiment along the line C—C in FIG. 9.

The second embodiment was so constructed that the diamond thin film 32 was circular and that the reinforcing frame 340 was annular, but, without having to be limited to this, the present invention may adopt other shapes, for example, a rectangular shape. The reinforcing frame 340 of the transmission type electron multiplier 60 may be of a grid pattern as shown in the perspective view of FIGS. 9 and 10. The reinforcing frame of this shape can be fabricated in arbitrary size and shape by the recent lithography technology. FIGS. 9 and 10 show the structure of the transmission type electron multiplier 90 according to this invention. The transmission electron multiplier 90 of this third embodiment is composed of the polycrystalline diamond thin film 32 and a pair of reinforcing plates 360*a*, 360*b*. The pair of these reinforcing plates 360*a*, 360*b* are provided each with a plurality of apertures 361. The pair of these reinforcing plates 360*a*, 360*b* are bonded to the corresponding principal planes of the polycrystalline diamond thin film 32 through adhesive 300 so as to hold the polycrystalline diamond thin film 32.

Further, the transmission type electron multipliers discussed above were of the polycrystalline diamond thin film or the porous polycrystalline diamond thin film, but a part thereof may be of monocrystalline, graphite, or diamondlike carbon.

As described above, the transmission type electron 14. multiplier and the electron tube provided therewith according to the present invention enable one to detect the positions of incidence of detected light by making the transmission type electron multiplier of the diamond thin film with the high secondary electron generation efficiency. Further, the electron tube provided with this transmission type electron multiplier can intensify an image of weak light.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 295189/1996 filed on Nov. 7, 1997 is hereby incorporated by reference.

What is claimed is:

1. A transmission type electron multiplier, comprising:

a diamond thin film electron multiplier element formed of diamond or of a material mainly composed of diamond, said multiplier element having a first major surface which electrons from an electron source reach and a second major surface for emitting secondary electrons; and a reinforcing member for supporting and reinforcing said multiplier element, said reinforcing member having an aperture for exposing at least a part of said multiplier element.

2. A transmission type electron multiplier according to claim 1, wherein said diamond thin film is made of polycrystalline diamond or a material mainly composed of polycrystalline diamond.

3. A transmission type electron multiplier according to claim 1, wherein said diamond thin film is a porous thin film and comprises an aggregate of particles independent of each other.

4. A transmission type electron multiplier according to claim 1, wherein said reinforcing member comprises:

a first member disposed on said first major surface of said diamond thin film and having an aperture for exposing at least a part of said first major surface; and a second member disposed on the second major surface of said diamond thin film and holding said diamond thin film in cooperation with said first member, said second member having an aperture for exposing said second major surface of said diamond thin film.

5. A transmission type electron multiplier according to claim 1, wherein said reinforcing member comprises:

a third member provided so as to cover the whole of said first major surface of said diamond thin film, said third member having a plurality of apertures located at predetermined intervals and provided for exposing associated parts of said first major surface of said diamond thin film; and a fourth member provided so as to cover the whole of said second major surface of said diamond thin film and holding said diamond thin film in cooperation with said third member, said fourth member having a plurality of apertures located at predetermined intervals and provided for exposing associated parts of said major surface of said diamond thin film.

6. An electron tube comprising:

a closed container;

an electron source housed in said closed container for emitting electrons into said closed container;

an anode housed in said closed container and located so as to face said electron source; and a transmission type electron multiplier provided between said electron source and said anode, said transmission type electron multiplier comprising:

a diamond thin film electron multiplier element formed of diamond or of a material mainly composed of diamond, said multiplier element having a first major surface which electrons from said electron source reach and a second major surface for emitting secondary electrons; and a reinforcing member for supporting and reinforcing said multiplier element, said reinforcing member having an aperture for exposing at least a part of said diamond thin film.

7. An electron tube according to claim 6, wherein said electron source comprises a photocathode which is an electrode for, in correspondence to a position of incidence of detected light, emitting a photoelectron excited from the valence band to the conduction band by light to be detected; and wherein said anode comprises such a fluorescent film that, with incidence of secondary electrons outputted from the electron multiplier in correspondence to positions of incidence to said transmission type electron multiplier where photoelectrons emitted from said cathode were incident, said fluorescent film emits light at positions where the secondary electrons are incident.

8. An electron tube according to claim 6, wherein said diamond thin film in said transmission type electron multiplier is made of polycrystalline diamond or a material mainly composed of polycrystalline diamond.

9. An electron tube according to claim 6, wherein said diamond thin film in said transmission type electron multiplier is a porous thin film and comprises an aggregate of particles independent of each other.

10. An electron tube according to claim 6, wherein said reinforcing member in said transmission type electron multiplier comprises:

a first member disposed on the first major surface of said diamond thin film and having an aperture for exposing at least a part of said first major surface; and a second member disposed on the second major surface of said diamond thin film and holding said diamond thin film in cooperation with said first member, said second member having an aperture for exposing the second major surface of said diamond thin film.

11. An electron tube according to claim 6, wherein said reinforcing member in said transmission type electron multiplier comprises:

a third member provided so as to cover the whole of the first major surface of said diamond thin film, said third member having a plurality of apertures located at predetermined intervals and provided for exposing associated parts of the first major surface of said diamond thin film; and a fourth member provided so as to cover the whole of the second major surface of said diamond thin film and holding said diamond thin film in cooperation with said third member, said fourth member having a plurality of apertures located at predetermined intervals and provided for exposing associated parts of the second major surface of the diamond thin film.

* * * * *